US005090160A

United States Patent [19]

Paquette

[11] Patent Number: 5,090,160

[45] Date of Patent: Feb. 25, 1992

[54] PLANER BLADE SHARPENING APPARATUS

[76] Inventor: Alfred J. Paquette, 96 White St., Westfield, Mass. 01085

[21] Appl. No.: 585,019

[22] Filed: Sep. 18, 1990

[51] Int. Cl.[5] ..... B24B 3/36

[52] U.S. Cl. ..... 51/102; 51/218 R; 51/238 R

[58] Field of Search ..... 51/216 R, 218 R, 224, 51/91 R, 91 BS, 92 BS, 98 BS, 23 BR, 238 T, 239, 102

[56] References Cited

U.S. PATENT DOCUMENTS

| | | | |
|---|---|---|---|
| 1,385,649 | 7/1921 | Sherman | 51/218 R |
| 2,579,680 | 12/1951 | Leighton | 51/102 |
| 2,645,063 | 7/1953 | Smith | 51/98 R |
| 2,681,531 | 6/1954 | Mastrone | 51/102 |
| 2,722,782 | 11/1955 | Metz | 51/102 |
| 2,915,854 | 12/1959 | Ettman | 51/102 |
| 2,998,683 | 9/1961 | Wegener | 51/216 R |
| 3,032,934 | 5/1962 | Johnsa | 51/218 R |
| 3,755,971 | 9/1973 | Garcia | 51/224 |
| 4,347,639 | 9/1982 | Tarte | 51/98 R |

*Primary Examiner*—Roscoe V. Parker
*Attorney, Agent, or Firm*—Leon Gilden

[57] ABSTRACT

A sharpening blade structure for use particularly in sharpening of blades utilized in plane tools, wherein a support base is mounted to an associated support surface such as a work bench, and a lower support block is mounted to the support base, a medial articulated link is mounted to the lower support block, wherein an upper support block is mounted to an upper terminal end of the articulated link. The upper support block is mounted to a blade support plate, wherein the blade support plate includes a forward edge, including a medially positioned "V" shaped notch to receive a peripheral surface of a rotating grinding wheel therethrough to effect sharpening of the blade structure. An adjustment block is mounted to permit positioning of the blade relative to the grinding wheel, as desired.

7 Claims, 4 Drawing Sheets

PLANER BLADE SHARPENING APPARATUS

BACKGROUND OF THE INVENTION

1. Field of the Invention

The field of invention relates to blade sharpening apparatus, and more particularly pertains to a new and improved planer blade sharpening apparatus wherein the same permits articulated positioning of a blade structure relative to a grinding wheel to accommodate and position various hollow-ground services of an associated planer blade.

2. Description of the Prior Art

Blade sharpening tools of various types have been utilized throughout the prior art. When a blade has incurred diminished efficiency due to repeated usage, a sharpening procedure is typically required. Unique hollow-ground type sharpening of conventional planer blades has afforded a degree of difficulty in permitting a duplication of a desired blade edge curvature. The instant invention attempts to overcome deficiencies of the prior art by permitting positioning and alignment of a planer blade relative to a grinding wheel and receive the grinding wheel through a blade support plate to permit duplication of a desired sharpened blade curvature. Examples of prior art structure may be found in U.S. Pat. No. 2,645,063 to Smith wherein a blade sharpening device utilizes a yoke member mounted overlying a grinding wheel and receiving the grinding wheel therewithin to permit sharpening of a blade.

U.S. Pat. No. 3,623,852 to Bushnell sets forth an apparatus for grinding thread cutting tools, wherein the same utilizes a plurality of relatively positionable slides to position a tool relative to a sharpening wheel.

U.S. Pat. No. 4,308,630 to Schmidt provides a deburring apparatus, wherein the protective front permits a blade-like member to be directed therethrough in confrontation with an associated grinding wheel.

U.S. Pat. No. 3,988,125 to Ulsh sets forth a support structure for mounting a portable power saw and permitting selective vertical movement of the power saw for cutting predetermined lengths of horizontal workpieces.

U.S. Pat. No. 4,347,639 to Le Tarte wherein a deburring apparatus utilizes a "V" shaped notch that receives and guides a blade therethrough to permit confrontation of the entire blade surface in confrontation with an associated deburring wheel.

As such, it may be appreciated that there continues to be a need for a new and improved planer blade sharpening apparatus wherein the same addresses both the problems of ease of use, as well as permitting effective support of a blade structure to permit duplication of a sharpened grinding edge curvature mounted within the blade structure and in this respect, the present invention substantially fulfills this need.

SUMMARY OF THE INVENTION

In view of the foregoing disadvantages inherent in the known types of blade sharpening apparatus now present in the prior art, the present invention provides a planer blade sharpening apparatus wherein the same accommodates and positions a planer blade overlying a notch and a grinding wheel received within the notch to permit sharpening of a lower forward edge of the associated blade. As such, the general purpose of the present invention, which will be described subsequently in greater detail, is to provide a new and improved planer blade sharpening apparatus which has all the advantages of the prior art blade sharpening apparatus and none of the disadvantages.

To attain this, the present invention provides a sharpening blade structure for use particularly in sharpening of blades utilized in plane tools, wherein a support base is mounted to an associated support surface such as a work bench, and a lower support block is mounted to the support base, a medial articulated link is mounted to the lower support block, wherein an upper support block is mounted to an upper terminal end of the articulated link. The upper support block is mounted to a blade support plate, wherein the blade support plate includes a forward edge, including a medially positioned "V" shaped notch to receive a peripheral surface of a rotating grinding wheel therethrough to effect sharpening of the blade structure. An adjustment block is mounted to permit positioning of the blade relative to the grinding wheel, as desired.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Tradmark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved planer blade sharpening apparatus which has all the advantages of the prior art blade sharpening apparatus and none of the disadvantages.

It is another object of the present invention to provide a new and improved planer blade sharpening apparatus which may be easily and efficiently manufactured and marketed.

It is a further object of the present invention to provide a new and improved planer blade sharpening apparatus which is of a durable and reliable construction.

An even further object of the present invention is to provide a new and improved planar blade sharpening apparatus which is susceptible of a low cost of manufacture with regard to both materials and labor, and which accordingly is then susceptible of low prices of sale to the consuming public, thereby making such planer blade sharpening apparatus economically available to the buying public.

Still yet another object of the present invention is to provide a new and improved planer blade sharpening apparatus which provides in the apparatuses and methods of the prior art some of the advantages thereof, while simultaneously overcoming some of the disadvantages normally associated therewith.

Still another object of the present invention is to provide a new and improved planer blade sharpening apparatus wherein the same permits articulation and positioning of a planer blade overlying a grinding wheel, wherein the grinding wheel is received within a notch of the apparatus to permit duplication of a sharpened blade radius of curvature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
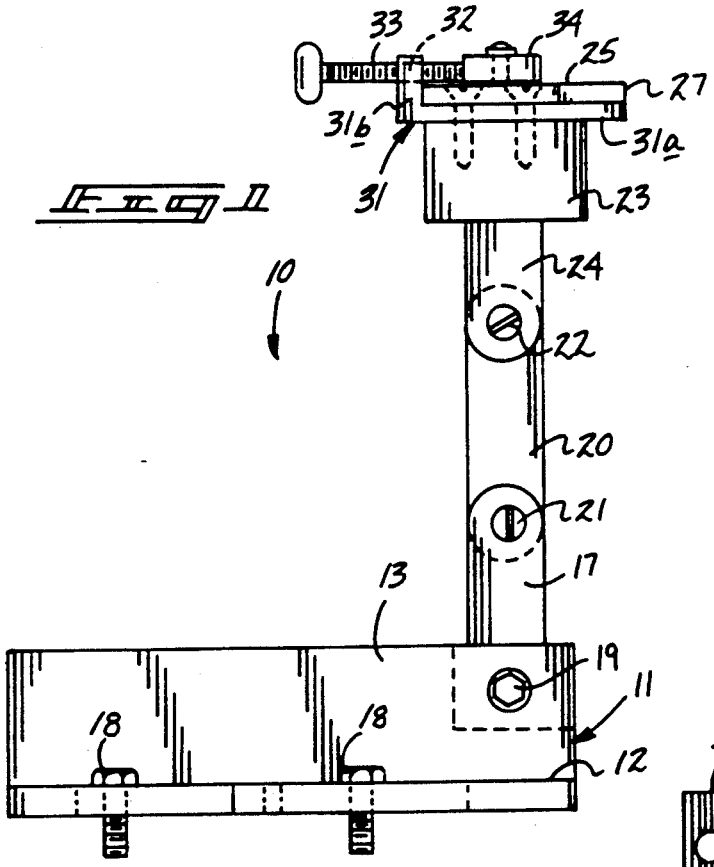
FIG. 1 is an orthographic frontal view of the instant invention taken in elevation.
Figure 2:
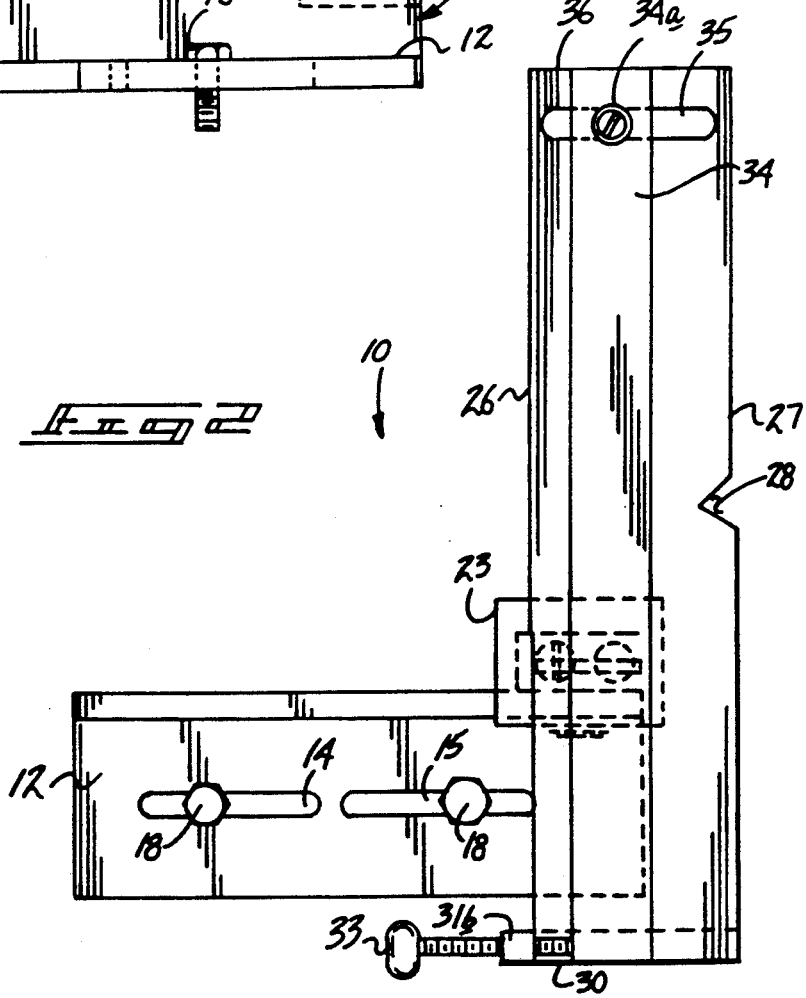
FIG. 2 is an orthographic top view of the instant invention.
Figure 3:
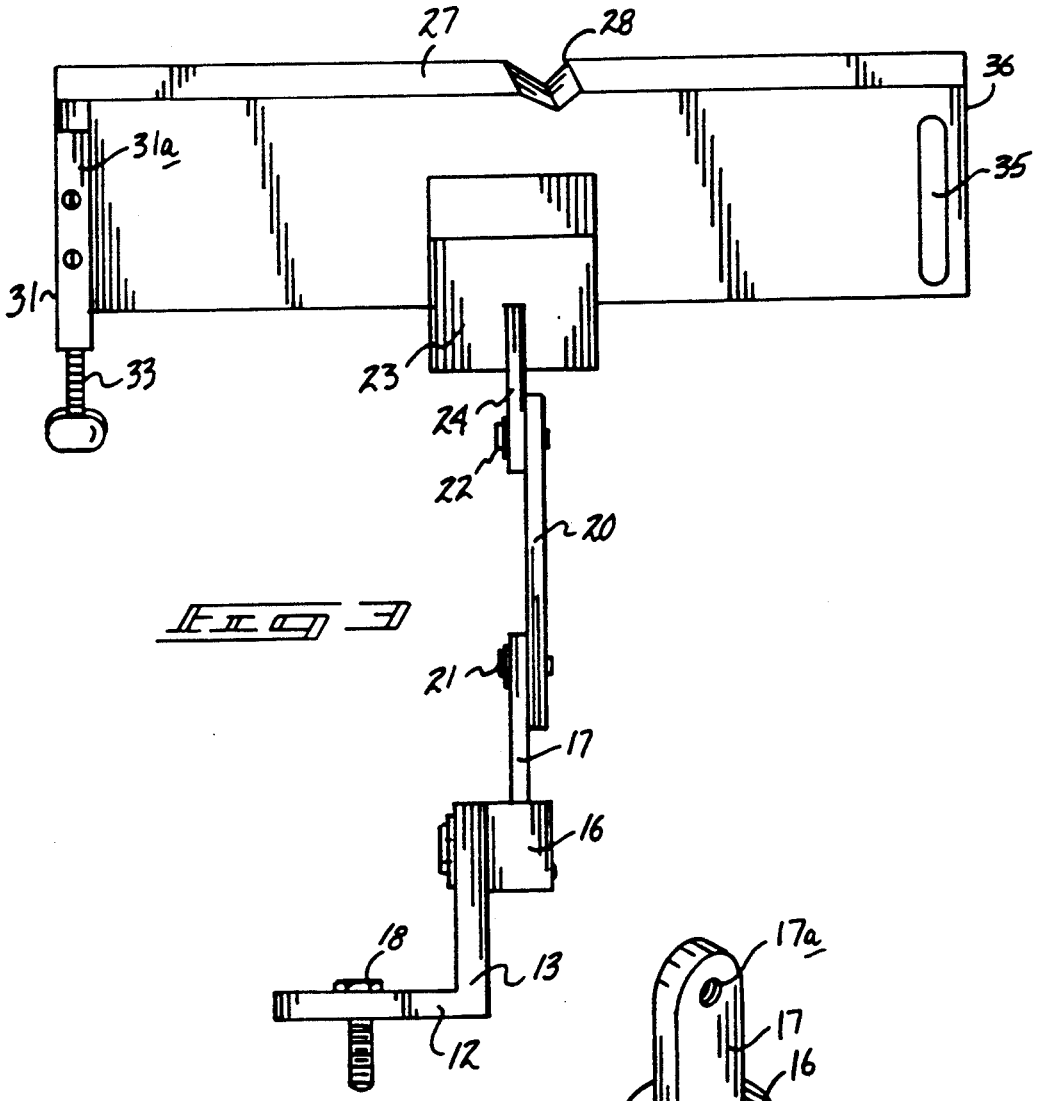
FIG. 3 is an orthographic rear view, taken in elevation, of the instant invention.
Figure 4:
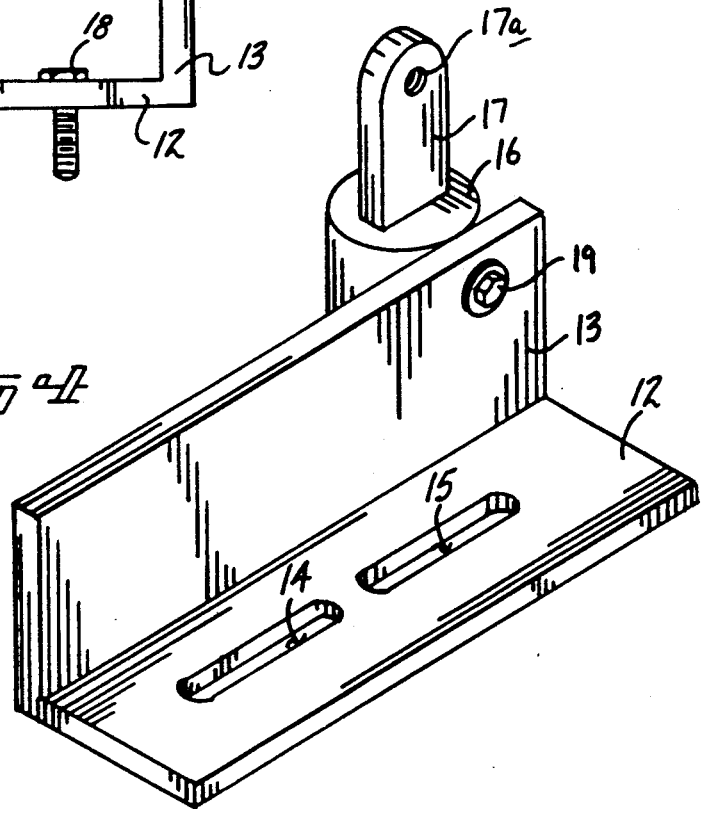
FIG. 4 is an isometric illustration of the support plate structure of the instant invention.
Figure 5:
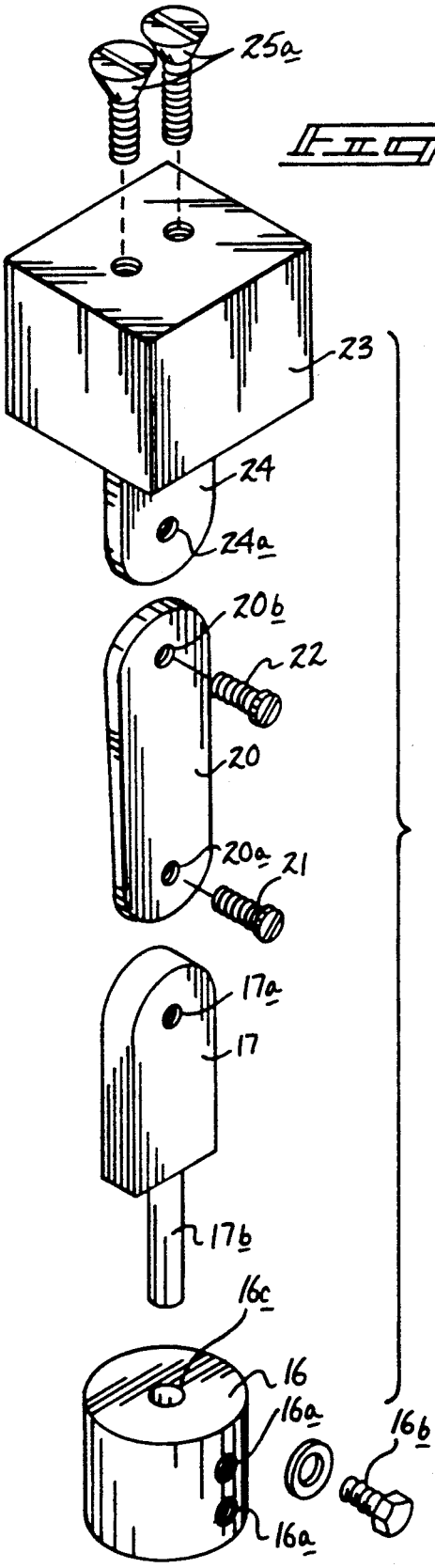
FIG. 5 is an isometric illustration, somewhat exploded, of the articulating link structure of the instant invention.
Figure 6:
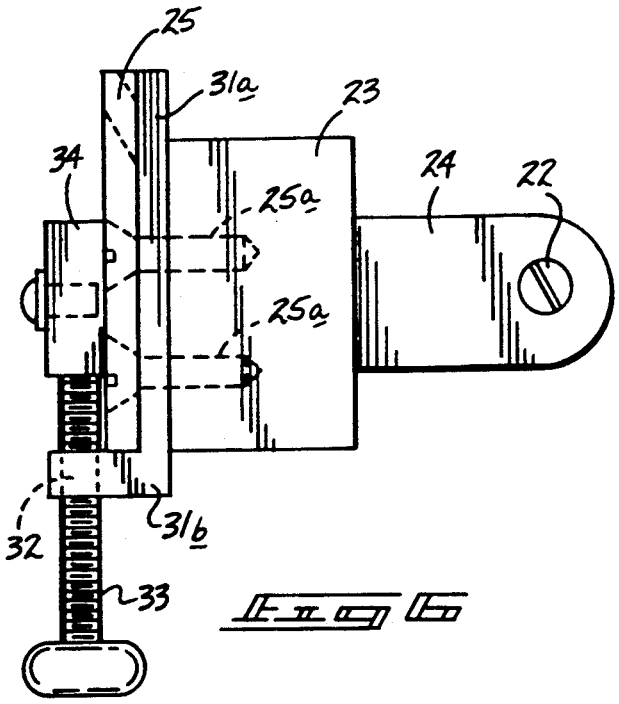
FIG. 6 is an orthographic end view of the blade support plate structure of the instant invention.

With reference now to the drawings, and in particular to FIGS. 1 to 7 thereof, a new and improved planer blade sharpening apparatus embodying the principles and concepts of the present invention and generally designated by the reference numeral 10 will be described.

More specifically, the planer blade sharpening apparatus 10 of the instant invention essentially comprises an "L" shaped support 11, including a planar horizontal base plate 12 integrally mounting a planar vertical base plate 13 coextensively and orthogonally along mating side edges of the horizontal and vertical base plates 12 and 13. The horizontal base plate 12 includes a first elongate slot 14 aligned with a second elongate slot 15 directed medially of a longitudinal axis defined by the horizontal base plate 12. A plurality of horizontal base plate fasteners 18 permits securement of the "L" shaped support 11 to a desired underlying structure, such as a work table and the like (not shown) of conventional configuration. A lower support block 16 is mounted to the vertical base plate 13 adjacent a forward edge of the vertical base plate, and includes a lower link arm 17 directed upwardly and orthogonally of the lower support block 16 arranged generally parallel to the vertical base plate 13 extending thereabove, and includes a lower link through-extending bore 17*a*. The lower link arm 17 includes a cylindrical rod integrally and longitudinally mounted to a lower end of the link arm 17 to be rotatably mounted and is received within a coaxial bore 16*c* directed through the lower support block 16 and selectively locked in position by one of a plurality of typical rod screw fasteners 16 received within bores 16*a* radially directed into coaxial bore 16*c*. The lower support 16 includes a lower support block threaded aperture 16*a* (see FIG. 5 for example) to receive a vertical base plate fastener 19 to secure the lower support block 16 to the vertical base plate 13 in an interlocked relationship.

Figure 7:
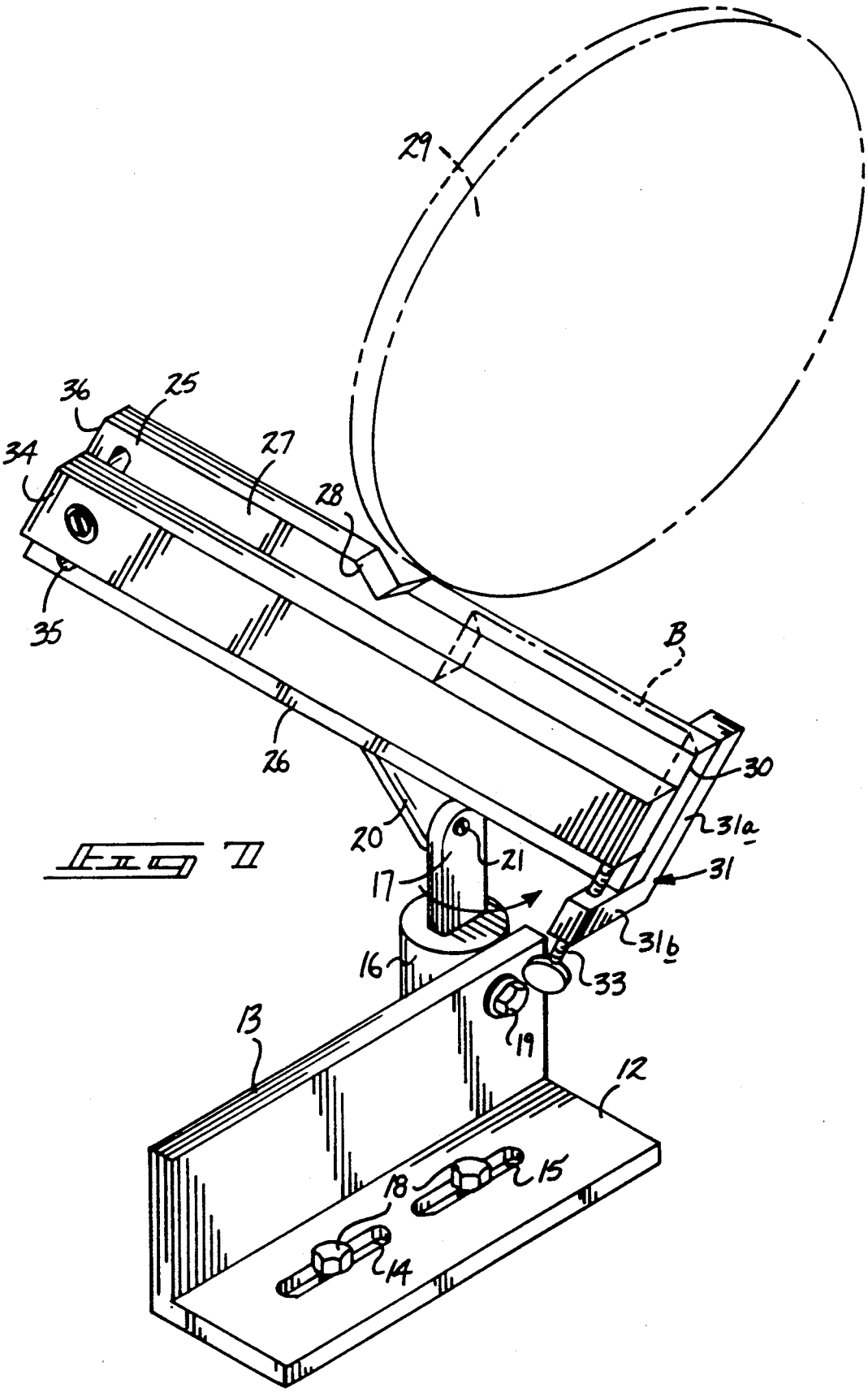
FIG. 7 is an isometric illustration of the instant invention in association with a grinding wheel.

A medial link 20 includes a lower threaded bore 20*a* and an upper threaded bore 20*b* directed through the medial link at respective lower and upper end portions of the medial link, wherein the bores 20*a* and 20*b* are arranged parallel relative to one another. A lower medial link fastener 21 is directed through the lower link arm bore 17*a* and received within the lower medial link threaded bore 20*a* to secure the medial link 20 to the lower link arm 17. An upper medial link fastener 22 is provided, wherein an upper link arm 24 formed with an upper link arm bore 24*a* receives the upper medial link fastener 22 therethrough and within the medial link upper threaded bore 20*a* to selectively and pivotally secure the upper link arm 24 to the medial link 20. The upper link arm 24 in turn is orthogonally and fixedly mounted to a bottom surface of an upper support block 23 that in turn is provided with a plurality of spaced and parallel upper support block threaded bores 23*a*. The bores 23*a* each receive a blade support fastener 25*a* therethrough to capture an elongate planar blade support plate 25 onto an upper surface of the upper support block 23. The blade support plate 25 includes a rear elongate edge 26 and a forward elongate edge 27 arranged parallel relative to one another, and further including a blade support plate right edge spaced from and parallel to a blade support left edge 36. A "V" shaped notch 28 is directed medially through the blade support blade 25 through its forward edge 27. As illustrated in FIG. 7, the "V" shaped notch 28 receives a peripheral edge portion of a grinding wheel 29 received through the notch 38 to permit sharpening of a planer blade "B" that is directed along the blade support plate 25 extending above the forward edge 27 to permit sharpening of an elongate edge of the blade "B". The blade support plate right edge 30 includes an "L" shaped adjustment link 31 that itself includes a first leg 31*a* mounted to a bottom surface of the blade support plate 25 adjacent the right edge 30, with a second leg 31*b* fixedly mounted to and extending above the first leg 31*a* and the blade support plate 25. A first leg threaded bore 32 threadedly receives an adjustment screw 33 therethrough. The adjustment screw 33 is positionable against an adjustment block 34 that is defined by an adjustment block length coextensive with a predetermined length defined by the blade support plate 25. The adjustment block 34 includes an adjustment block fastener 34*a* directed through the adjustment block and received within a support plate slot 35 formed through the blade support plate 25 adjacent to and parallel the blade support plate left edge 36. In this manner, a loosening of the adjustment block fastener 34*a* permits rotation of the adjustment screw 33 against a rear surface of the adjustment block 34 to position a forward edge surface of the adjustment block 34 relative to the forward edge 27 of the blade support plate 25 and thereby permit precise positioning of the planer blade "B" relative to the rotating grinding wheel 29 to effect a sharpening of the blade "B" in a manner as noted above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A blade sharpening apparatus comprising, an "L" shaped support base, the "L" shaped support base including a horizontal base plate for securement to a support surface, and a vertical base plate integrally and orthogonally mounted to the horizontal base plate extending above the horizontal base plate, and a blade support plate cooperatively mounted to the vertical base plate, and including a rear edge, and a forward edge spaced from and parallel to the rear edge, the forward edge including a "V" shaped notch formed within the forward edge of the blade support plate medially thereof extending interiorly of the blade support plate, and the blade support plate further including a left edge spaced from and parallel to a right edge, and the blade support plate positioned for sliding securement of a planer blade for directing the blade over the forward edge and the associated "V" shaped notch, and articulating link means articulatingly mounting the blade support plate to the vertical base plate.

2. An apparatus as set forth in claim 1 wherein the blade support plate further includes an "L" shaped adjustment link, the "L" shaped adjustment link mounted to a bottom surface of the blade support plate adjacent the right edge of the blade support plate, and the adjustment link including a first leg fixedly mounted to the blade support plate adjacent the right edge and a second leg of the "L" shaped adjustment link orthogonally and fixedly mounted to the first leg and extending above the first leg and an upper surface of the blade support plate adjacent the rear edge of the blade support plate, and the second leg including a threaded bore directed therethrough, and an adjustment screw directed through the threaded bore, the adjustment screw including a forward end, and an adjustment block mounted on the upper surface of the blade support plate, the adjustment block defined by an adjustment block length substantially equal to a predetermined length defined by the blade support plate, and the adjustment block positioned against the forward end of the adjustment screw to permit positioning of the adjustment block relative to the forward edge of the blade support plate.

3. An apparatus as set forth in claim 2 wherein the adjustment block further includes an adjustment block fastener directed therethrough, and the blade support plate includes a blade support slot directed parallel to the left edge of the blade support plate to permit sliding adjustment of the adjustment block by the adjustment screw upon loosening of the adjustment block fastener relative to the blade support plate.

4. An apparatus as set forth in claim 3 including a rotating grinding wheel, the rotating grinding wheel including a peripheral edge, the peripheral edge positioned through the "V" shaped notch to cooperate with the planer blade for sharpening of the planer blade as it is directed along the blade support plate relative to the grinding wheel.

5. An apparatus as set forth in claim 4 wherein the articulating link means includes a lower support block, the lower support block including a lower link arm orthogonally and rotatably received through an upper surface of a lower support block within a coaxial lower support block bore, the lower support block fixedly mounted to the vertical base plate adjacent a forward edge of the vertical base plate, and a medial link adjustably and pivotally mounted to an upper terminal end of the lower link arm, and an upper link arm pivotally mounted to an upper terminal end of the medial link, and the upper link arm orthogonally and fixedly mounted to a bottom surface of an upper support block, the upper support block including a top surface, the top surface of the upper support block fixedly mounted to the bottom surface of the blade support plate.

6. An apparatus as set forth in claim 5 wherein the upper support block includes a plurality of threaded bores, the threaded bores arranged parallel to one another, and each receiving a support fastener directed through the blade support plate and received within a respective upper support block threaded bore.

7. An apparatus as set forth in claim 6 wherein the medial link includes an upper threaded bore spaced from and parallel to a lower threaded bore, wherein the upper and lower threaded bores are respectively positioned adjacent upper and lower terminal ends of the medial link, and the lower link arm includes a bore directed therethrough, and a lower medial link fastener directed through the lower link arm bore and received within the lower threaded bore of the medial link, and the medial link including a medial link upper fastener, wherein the medial link upper fastener is directed through an upper link arm bore and received within the medial link upper threaded bore, whereupon the medial link permits relative vertical and pivotal positioning of the blade support plate relative to the lower support block.

* * * * *